United States Patent [19]

Trobaugh

[11] 4,268,383

[45] May 19, 1981

[54] FLOW SYSTEM CONTROL WITH TIME DELAY OVERRIDE MEANS

[75] Inventor: Arnold G. Trobaugh, Milwaukee, Wis.

[73] Assignee: Johnson Controls, Inc., Milwaukee, Wis.

[21] Appl. No.: 23,679

[22] Filed: Mar. 26, 1979

[51] Int. Cl.[3] ..... C02C 1/00

[52] U.S. Cl. ..... 210/103; 210/109; 210/138; 137/487.5

[58] Field of Search ..... 210/103, 105, 109, 138, 210/139, 170, 87; 137/247.15, 236 R, DIG. 8, 487.5

[56] References Cited

U.S. PATENT DOCUMENTS

| | | | |
|---|---|---|---|
| 3,397,784 | 8/1968 | Carr | 210/138 X |
| 3,730,884 | 5/1973 | Burns et al. | 210/109 X |
| 3,777,778 | 12/1973 | Jano | 137/487.5 |
| 4,155,851 | 5/1979 | Michael | 137/236 R |

*Primary Examiner*—John Adee

*Attorney, Agent, or Firm*—Andrus, Sceales, Starke & Sawall

[57] ABSTRACT

A vacuum operated sewage system includes a static pressure sensor establishing a trigger signal at a selected first level in a standpipe. The sensor is connected upstream of a discharge control valve and actuates a trigger and timer controller at the selected sensed pressure to establish flow for a predetermined period. A separate air admission control is provided to separately actuate the timer controller if the vacuum level in the sewage flow line drops below a selected level, to thereby reset the system vacuum pressure. The air admission control includes a level trigger valve operable to actuate the controller. A by-pass pressure sensing valve has an input connected to sense line pressure and holds the trigger valve in standby until the line pressure drops below a selected vacuum pressure. A resettable fluid timer is also connected to the level trigger valve and is charged under normal pressure system conditions. The timer holds the trigger valve in the set state for a selected period after the by-pass sensing valve responds to system level pressure decreasing below the selected minimum operating pressure and thereby prevents response to momentary changes in the flow line vacuum level.

12 Claims, 1 Drawing Figure

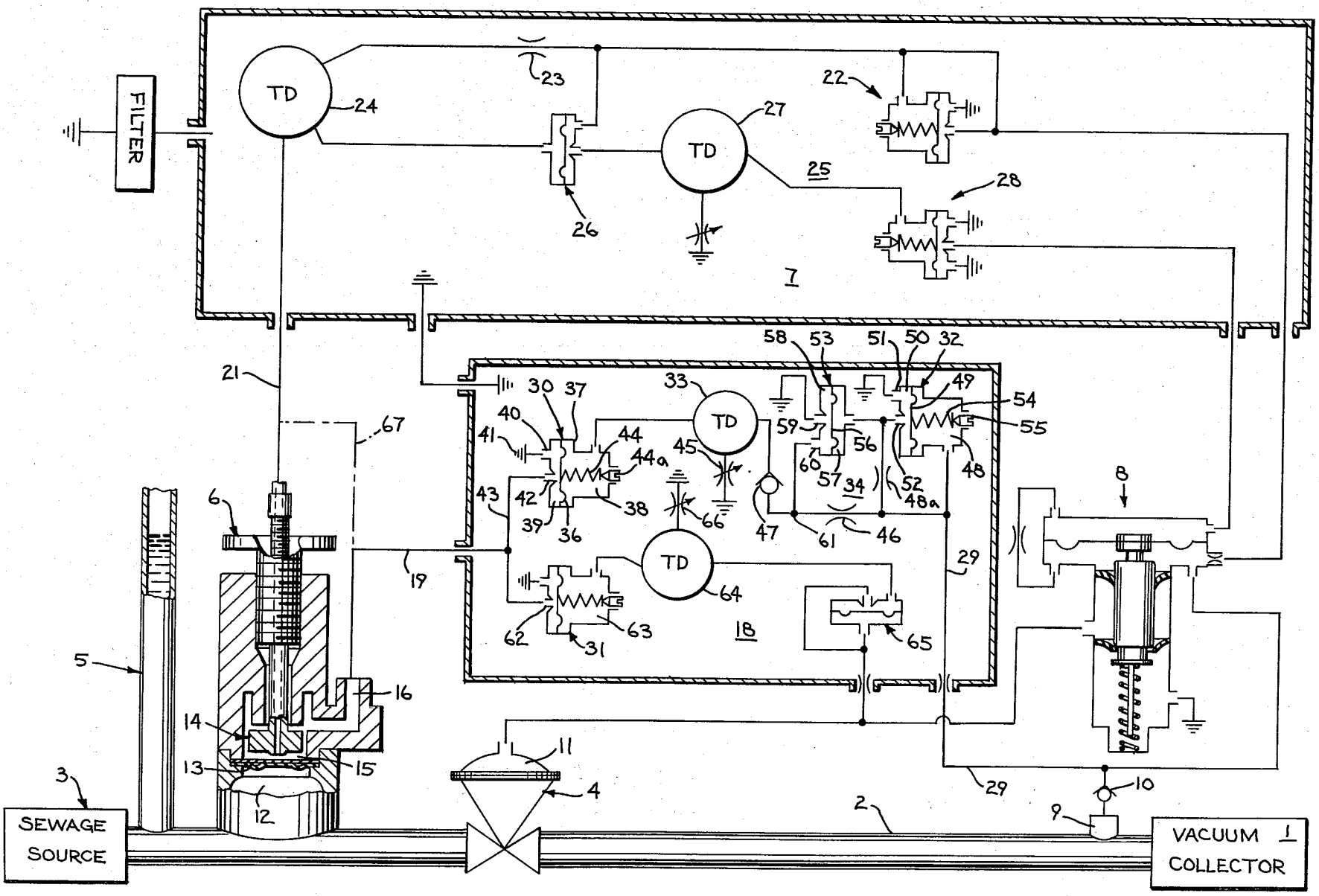
VACUUM COLLECTOR
SEWAGE SOURCE
FILTER
TD
TD
TD
TD

FLOW SYSTEM CONTROL WITH TIME DELAY OVERRIDE MEANS

BACKGROUND OF THE INVENTION

This invention relates to a pressure flow controller and particularly to such a controller for a vacuum operated flow system having means responsive to abnormal conditions to establish a flow.

In flow systems, the pressure differential for establishing flow may include a downstream vacuum source. A temporary storage means such as a storage tank, a standpipe or the like within which liquid is stored until it reaches a selected level may be incorporated into the system. When such a selected level is reached, a discharge apparatus is actuated to remove liquid generally until a lower limit is established.

A particularly satisfactory two-position liquid level controller for a vacuum operated sewage disposal system and the like is disclosed in U.S. Pat. No. 3,777,778 and in the copending application of Trobaugh et al entitled "Flow System With Pressure Level Responsive Air Admission Control" filed on Oct. 28, 1977 with Ser. No. 846,405. In that fluid system a sensor is mounted upstream of a discharge control valve and is connected to actuate a triggered controller having a fluid relay connected to charge a fluid timing capacitor which, in turn, actuates a fluid switch.

When the output signal from the sensor is received, the vacuum connection to the capacitor is momentarily made and the vacuum established as a reference. The storage device signals the fluid switch which actuates a pilot valve to open the main valve. The sewage flow continues until such time as the main capacitor has totally discharged, at which time the switch converts to an "off" condition, resetting the pilot valve and moving the main valve to a closed condition.

In operation of such vacuum operated systems, a low vacuum condition may be created in the sewer line between the main control valve and the vacuum source by low points in the flow line being filled by sewage and/or by a partial system bogdown or water logging. The sewage or water laying in the low points thus prevents creation of system vacuum and interferes with proper system operation. The system vacuum can be restored by admitting air into the system to force the sewage in such low points forward toward the collection station and clearing of such low points.

The above identified application provides an automatic admission control means for sensing a low system pressure condition and signalling the controller for supplying pressure to the line and thereby positively clearing of the system line and re-establishing proper system pressure.

The particular air admission valve means shown therein includes a diaphragm bleed valve connecting the controller trigger input to a signal pressure. The bleed valve includes a pressure input connected to the vacuum side of the line to establish the trigger signal when the vacuum falls below a selected level. A parallel bleed-type reset valve is connected in parallel with the trigger valve and is actuated by application of valve opening pressure to the main valve to reset the input to the controller.

Although the air admission control produces a satisfactory means of triggering the controller, the inventor has found that undesirable triggering may occur under transient pressure conditions.

Thus, various operating systems may encounter a momentary or transient low vacuum pressure condition as a result of normal operation. Under such conditions of course, the air admission control unit would normally respond to actuate the main valve unit even though the system did not require such action. Further, in a vacuum actuated operated sewage flow system, a number of valve assemblies may be operating at essentially the same static head and as a result of corresponding operations generate a momentary low vacuum condition from the main vacuum supply or source. Such a condition would, of course, be transmitted to other units and result in the further actuation of other valve subassemblies even though, in fact, such branches were operating in accordance with designed characteristics and there was no need for such additional controlled valve operation. The unnecessary operation consumes energy as well as requiring component operation without any functional benefit.

SUMMARY OF THE INVENTION

The present invention is particularly directed to a sewage system having a triggered controller with an automatic pressure level air admission control in combination with a timed disable control means which actuates an interlock system only with abnormal system pressure conditions existing for a sufficient period to warrant establishing of flow. More particularly, in accordance with the present invention, an admission control means is connected directly to the trigger input of the controller or in series with a normal system operating sensor to actuate the controller. The air admission control includes an air admission valve means, preferably a bleed-type trigger valve, having a pressure input connected to the vacuum side of the line to establish the trigger signal when the vacuum falls below a selected level. A timing means holds the trigger valve insensitive to a momentary change.

In a particular embodiment, a level sensing valve means is connected to sense line pressure and to selectively apply line pressure to a resettable timing means and the input of the trigger valve means. The level sensing valve means is actuated by application of normal line pressure and supplies line pressure to the timing means and the trigger valve means and holds the trigger input to the controller in a normal standby state. The timing means provides a holding signal to the trigger valve means for a selected period after the line signal is removed by actuation of the level sensing valve means. The trigger valve means is therefore held in the standby state for a selected period after actuation of the level sensing valve by the abnormal pressure condition. The period is selected to allow transient pressure conditions while maintaining control in response to undesirable loss of system vacuum.

In a preferred embodiment of the invention, the timing means is a resettable capacitor or storage means connected in series with a diode and the input of the trigger valve means to a pressure sensing line. The capacitor is connected to atmosphere through a discharge rate control, and is charged under normal line pressure conditions. The level valve means is connected to selectively connect the diode to atmosphere and allow the capacitor to discharge through the rate control to the trigger level of the trigger valve means. The level sensing valve is preferably connected via a fluid relay to the line side of the diode. The trigger valve means is set to respond to an input vacuum level which is substantially less than both system pressure and the pressure operative to actuate the sensing valve means, and the trigger valve means is held inoperative by the timing capacitor which is normally at line pressure. In this embodiment, the trigger valve means provides a connection of the controller input to ground or reference pressure in the presence of proper system vacuum. If the vacuum should drop below the minimum desired vacuum level, the level sensing valve means opens and system pressure is removed from the timing means and the trigger valve means. The capacitor then begins to charge from the last line vacuum level which will be above the level necessary to hold the trigger valve means open. The capacitor thus delays the transmission of a switching signal and holds the trigger valve open to maintain normal system operation until the capacitor charges to the set point of the trigger valve means, at which time the trigger valve closes and transmits an air admission control signal to the controller.

The present invention provides a reliable means which may employ readily available components for automatically cycling a controller to introduce air into a vacuum operated system permitting normal system operation.

BRIEF DESCRIPTION OF THE DRAWING

The drawing furnished herewith illustrates a preferred construction of the present invention in which the above advantages and features are clearly disclosed as well as others which will be readily understood from the description of such illustrated embodiment.

The drawing is a schematic circuit illustrating a vacuum operated sewage flow system having a controller and an air admission control apparatus constructed in accordance with the present invention to introduce a time delay in the response thereof to positively prevent response to transient pressure conditions.

DESCRIPTION OF THE ILLUSTRATED EMBODIMENT

Referring to the drawing, a sewage flow system, similar to that disclosed in U.S. Pat. No. 3,777,778 and particularly the previously identified application, includes a vacuum collector 1 at a collection end of a flow line 2 coupled to a sewage source 3. A main discharge valve 4 is provided in the flow line 2 and is periodically actuated to provide for transfer of a predetermined amount of sewage to the collector. A standpipe 5 is connected to the upstream end of the flow line 2 and within which the sewage will accumulate. As the sewage accumulates, the hydrostatic pressure in the flow line 2 increases accordingly. A hydrostatic pressure sensor 6 connected to the flow line 2 responds to the hydrostatic pressure and at a selected pressure level actuates a pneumatic triggered timing controller 7, which, in turn, is connected to actuate a pilot valve 8. The main valve 4 is selectively opened and closed by the operation of pilot valve 8 connecting pressure to an operating valve chamber 11. The pressure responsive valves 4 and 8, sensor 6 and timer 7 are connected directly into the vacuum system via a connection tap 9 and a check valve 10 such that the system is driven from the line pressure.

Sensor 6 is a leakport unit having an inlet chamber 12 coupled to the line 2 to impress flow line pressure upon a diaphragm 13. An adjustable mounted orifice unit 14 is located in alignment with the central portion of the diaphragm 13 within an exhaust chamber 15 which includes a reference port 16. The port 16 is connected to atmosphere or reference pressure by an air admission control means 18 via a line 19. Control means 18 particularly forms an embodiment of this invention, as more fully described hereinafter.

The adjustable orifice 14 of sensor 6 is thus normally connected to the exhaust via the port 16, line 19 and air admission control 18 in accordance with the spacing of the diaphragm 13 to provide a leakport type operation. The output of the sensor 6 is connected to a back pressure signal line 21 which is connected to controller 7 which includes a vacuum regulator 22 connected to line connection 9 to develop a pressure signal to controller 7. A restrictor 23 and time delay unit or capacitor 24 connects the output of regulator 22 to line 21.

The output signal from sensor 6, which is either atmosphere or regulated vacuum is transmitted via unit 24 to actuate a fluid switching system 25 which includes a fluid relay 26 coupled through a timing capacitor 27 to operate a diaphragm switch 28. The output of switch 28 is connected to the input or signal chamber of valve 8 and functions as more fully described in U.S. Pat. No. 3,777,778 to operate three-way pilot valve 8 which operates main valve 4.

The air admission control means 18 monitors the vacuum pressure level in the line 2 downstream of valve 4, and particularly at connection 9 in the illustrated embodiment via a connecting sensing line 29. If the monitored vacuum pressure in the flow line 2 drops below a selected vacuum pressure level, the control means 18 is actuated to close the connecting line 19 from port 16, simulate the diaphragm closing of orifice unit 14 and trigger the controller 7 to produce a timed opening of the valve 4, generally as disclosed in the previously identified copending application.

Thus, if either the sensor 6 or valve means 18 is actuated, the atmospheric pressure to controller 7 is cutoff and controller 7 is triggered to initiate a timing cycle which is completed even though the triggering source, sensor 6 or air admission means 18, is reset.

The controller 7 and related valves 4 and 8 are more fully disclosed in the above application and are therefore only briefly described herein in sufficient detail to clearly set forth the illustrated embodiment of the invention.

The air admission control means 18 includes a trigger valve 30 and a low level sensing reset valve 31 connected to control the triggering of controller 7 in response to a loss of vacuum at the valve 4, generally as in the cross-referenced application. A high level sensing valve 32 and a timing means, shown as a fluid capacitor 33, which particularly illustrates one embodiment of the present invention, are connected in a network 34 to delay the operation of the trigger valve 30 and thereby prevent response to momentary transient decreases in the vacuum level in line 2. The high level sensing valve 32 is connected to selectively supply and by-pass a line pressure connection to the timing capacitor 33, and thereby establish a conjoint timed control of the signaling of trigger valve 30 in response to loss of vacuum pressure.

The output side of valves 30 and 31 are connected in parallel between the sensor 6 and the atmosphere. Under normal operation, one of the valves 30 or 31 is open to supply atmospheric pressure to the sensor 6 and provide for the normal controller operation. Valve 30 is especially coupled to the line 29 via the timing network 34 and reset valve 31 is coupled to the output of the pilot valve 8 for sequential controlling of the system in response to abnormal pressure conditions, and during normal vacuum pressure conditions permitting normal operation of controller 7.

The illustrated valve 30 is an adjustable set point diaphragm valve similar to the pressure regulator valve 22 and the switching valve 28. The valve 30 thus includes a diaphragm 36 in a valve body 37 and defining a pressure input chamber 38 and an output or control chamber 39. The control chamber 39 includes a port 40 connected to atmosphere at 41 and a nozzle or orifice 42 connected by line 43 to the sensor line 19 and reference port 16. The orifice 42 is opened and closed by the diaphragm 36 which is biased to a closed orifice position by a preload coil spring 44 coaxially located within the chamber. An adjustment screw 44*a* is threaded into the body and controls the closing force of spring 44 applied to diaphragm 36. The pressure input chamber 38 is connected in series with the timing means 33, as more fully described hereinafter, to the vacuum signal line connection or tap 9 to the downstream side of check valve 10 such that the vacuum pressure of line 2 is applied to the diaphragm 36. The diaphragm 36 is, therefore, positioned by the differential fluid pressure in the chambers 38 and 39 and the force of spring 44. Under a normal operating vacuum level, the pressure differential is such that the spring force is overcome, the valve 30 opens and connects the sensor reference port 16 to atmospheric pressure. However, as the line vacuum pressure falls, the timing network responds to decrease the pressure differential such that at a selected pressure level, the spring force predominates and the valve 30 closes. This cuts off the reference pressure connection, assuming the parallel valve 31 is also closed as hereinafter described, and the controller 7 is triggered and set to complete a cycle, which functions in the same manner as previously described to open the main valve, thereby introducing air into the system upstream of the sewage and forcing the sewage from the low point. The cycle is completed by the closing of the vacuum switch. The initiation of the cycle is controlled by the timing network 34 to prevent response to momentary vacuum losses at valve 4.

The timing capacitor 33 of the air admission control 18 particularly provides a time delay in the actuation of valve 30 for preventing system triggering as a result of transient changes in the flow line system pressure.

The timing means 33 is any resettable pressure chargeable device, such as a fluid storage tank. A discharge orifice 45 is provided to continuously discharge the tank at a selected rate to atmosphere. The discharge rate is less than the vacuum charging rate with normal vacuum system pressure applied via line 29, a restrictor 46 and a diode or check valve 47. Under normal operating vacuum pressure, the capacitor tank 33 is therefore held at a vacuum pressure essentially corresponding to line vacuum pressure. If the line vacuum decreases, the capacitor 33 discharges accordingly. At a selected level, generally related to a water logged or sewage block state, as previously discussed, the corresponding pressure level actuates valve 32 which operates to disconnect capacitor 33 from line pressure and permits capacitor 33 to discharge to the operating level of trigger valve 30. The valve 32 and the timing means 33 thus conjointly control the trigger valve 30 to automatically trigger the controller 7 to open the main valve 4, and, thereby, introduce air into the system, if the vacuum falls to a selected level for a selected time period, as follows.

More particularly, the valve 32 is also a diaphragm operated leakport unit corresponding to valves 30 and 31. The input chamber 48 of vacuum level sensing valve means 32 is connected to the system sensing pressure line 29 to the upstream side of the dropping restrictors 46 and 48*a*. The valve 32 includes the movable diaphragm 49 defining the input chamber 48 and an output chamber 50 which includes a supply port 51 connected to the atmosphere and an output orifice 52 connected to an interlock relay 53, which is operable to selectively disconnect timing means 33 from line 29. A set point adjust spring 54 within the input chamber 48 biases the diaphragm 49 to close the orifice 52. A pressure level adjustment screw 55 controls the setting of the coil spring pressure and with the system vacuum pressure applied via the sensing line 29 conjointly establishes response to a decrease in system pressure. The interlock relay 53, illustrated as a diaphragm unit, includes a diaphragm 56 defining an input chamber 57 connected to orifice 52 and dropping restrictor 48*a*. The output orifice 59 is connected to atmosphere. Port 60 is connected between the check valve 47 and the dropping restrictor 46 to selectively connect such point 61 to ground atmosphere as the reference. In operation, the valve means 32 will be set at a selected system pressure such as to hold the orifice 52 open as a result of proper system pressure. Atmospheric pressure is therefore normally coupled to input chamber 57 of relay 53, which is thereby held closed, allowing pressure transmission to the capacitor 33 via valve 47. Vacuum pressure is, therefore, applied via restrictor 46, check valve 47 and capacitor 33 to the valve 30. The vacuum in the input chamber 38 of valve 30 holds it open and establishes the response to the sensor 6 as previously described.

When the line pressure drops to a selected level, valve 32 closes, relay 53 opens and by-passes the vacuum pressure connection 61 at the input side of the check valve 47 directly to atmosphere. The line vacuum is then by-passed to atmosphere. The capacitor 33 then discharges toward atmospheric pressure via its orifice 45 and after a timing period, the capacitor 33 discharges to the trigger level of the valve 30. After such time delay, the trigger valve 30 closes, thereby blocking the flow path from sensor 6 and developing a back-pressure signal in line 21, in the same manner as that previously described.

As a result of the above, the trigger and timing controller 7 is triggered with the same sequence previously described to open the main valve, thereby admitting air and perhaps some amount of sewage into the discharge system to break any blockage in the system and restore normal system operation.

After initiation and during the forced controller cycle, the air admission controller 18 is reset by opening of the reset valve unit 31, as more fully described in the cross-referenced application. Generally, reset valve 31 is a diaphragm unit having an orifice 62 connected to provide the alternate, paralleled connection of the sensor 6 to the atmosphere. The input chamber 63 is connected to the input chamber 11 of main valve 4 in series with a timing capacitor 64, and a fluid diode 65 shown as a diaphragm leakport unit connected to function as a fluid diode. A discharge orifice 66 connects capacitor 64 to atmosphere. In the standby condition, valve 31 is held closed through the connection to atmospheric pressure applied to valve 4 from pilot valve 8. When valve 30 closes to trigger controller 7, vacuum pressure is applied through timing capacitor 64 to the reset valve 31 which now opens and connects the sensor 6 to atmosphere. The input to the controller 7 is therefore reset and the controller 7 completes the timed cycle.

Upon completion of the controller cycle, pilot valve 8 resets and main valve 4 closes. The valve 30 has been held closed by the opening of main valve 4, which results in a drop in the vacuum level at valve 4 as flow is created, and thus would tend to trigger a new cycle. However, the reset valve 31 is opened, as noted above, and during a short period capacitor 64 holds valve 31 open by maintaining a vacuum pressure in input chamber 63 which allows valve 31 to open nozzle 62 and thereby reset the air admission controller.

The system thus resets to the normal standby position in which the system is again responsive directly to the operation of sensor 6 or to a subsequent drop in line pressure vacuum.

If system pressure has not been restored, the device again sequences upon the closing of reset valve 31, without any further time delay. Thus, the low vacuum pressure condition during the cycle is applied and without a return of a vacuum state, the means for charging of the time delay capacitor 33 of network 34 is lost, and valve 30 remains closed.

If the operating vacuum pressure has been restored, however, the system returns to the standby state with the capacitor 33 charged to hold valve 30 open. Level pressure sensing valve 32 is also held open by line vacuum pressure condition and the ground connection of point 61 removed.

The time delay network 34 may be set to any desired time period. Generally, in a practical system a setting of approximately one minute delay provides a highly satisfactory response characteristic.

Although shown employed as an addition to a hydrostatic sensor controlled system, the control means may, of course, be directly applied to actuate the illustrated triggered controller or any other similar controller. For example, if the connecting line 19 is connected directly to line 21, as shown in phantom at 67, and the sensor 6 removed, the system will open valve 4 whenever operating line vacuum is lost.

The illustrated embodiment discloses a preferred and particularly novel construction employing a series connected timing means with a selective grounding of the input. Various other systems of either a parallel or series connection and employing other than the illustrated diaphragm type valve means may be employed within the teaching of the present invention. The preferred embodiment employs well-known and commercially available components and may be attached to existing controllers. The preferred embodiment is, therefore, particularly adapted to practical implementation.

Various modes in carrying out the invention are contemplated as being within the scope of the following claims, particularly pointing out and distinctly claiming the subject matter which is regarded as the invention.

I claim:

1. A sewerage flow control system having an accumulating means for storing of sewerage and means for establishing a predetermined differential pressure in a line connected to said accumulating means and to said collector means and having a normally closed main valve means in said line upstream of said collector means for deliverying of accumulated fluid medium to said collector means, comprising a controller having sensing means to sense the pressure condition upstream of said valve means and having valve control means actuated by said sensing means for selectively opening said normally closed valve means to apply said pressure to the opposite side of the valve means and to establish a predetermined flow cycle for delivery of said fluid medium, and pressure control means to sense the pressure in the downstream side of the valve means with the valve means closed and connected to actuate said valve control means of said controller to open said valve means to initiate said flow cycle in response to an abnormal pressure condition between the valve means and the collector means and operating independently of the sensing means, and said pressure control means including a time delay means to restrict the response thereof to a time period in excess of transient abnormal pressure condition created between the valve means and the source means, whereby said valve control means is independently actuated by said sensing means and by said pressure control means.

2. The flow control system of claim 1 including a plurality of flow branches interconnected to the collector means and each having a main valve means, opening of anyone of said valve means being capable of establishing said transient abnormal pressure condition in another one of said branches for a given time, and said time delay means being selected to establish a time period in excess of such pressure condition given time.

3. In the flow control system of claim 2 wherein said control means includes a trigger valve means for selectively supplying a control signal to the controller, said trigger valve means having a fluid responsive input chamber, said time delay means including a resettable fluid storage means connected to said trigger valve means and to said flow line to transmit said flow line pressure to said trigger valve means and maintain said pressure in response to a selected drop in the line for a selected time period.

4. In the sewage flow system employing a vacuum source means connected to the downstream end of a sewer line buried in the ground for conducting sewage through the line as a result of pressure and which line may include low accumulating portions, a fluid activated sewer line valve means having an operator means for opening and closing said sewer line, a fluid controller means having an input means for timed actuation of said operator means of said valve means, fluid supply means for supplying fluid to said controller and said operator means, a fluid admission control means connecting said fluid supply means to said controller and including a timed signal means having an input means coupled to said sewer line downstream of said valve means and having a time delay means to limit operation thereof to an input signal of a minimum duration, said input means transmitting said line pressure to said signal means to actuate the control means in response to a selected change in line pressure of said minimum duration, said control means including reset means for resetting the admission control means in response to the opening of the line valve means.

5. In the system of claim 4 wherein said timed signal means includes a low level pressure sensing valve means connected to selectively connect said time delay means to said sewer line downstream of the sewer line valve means, said timing delay means being a rechargeable fluid storage means having a selected discharge rate and operable to hold the signal means in a standby position for a predetermined period after said selected change in line pressure.

6. The system of claim 4 wherein said controller means includes a trigger valve means having an input chamber, said time delay means include a rechargeable timing capacitor connected to the input chamber of the trigger valve means, said capacitor having a controlled continuous discharge, a system pressure sensing line, an interlock means having a sensing valve means connected between the capacitor and said system pressure sensing line and having an input pressure means connected to said system pressure, said sensing valve means being connected to by-pass said signal line and said capacitor to reference pressure in response to said abnormal pressure condition and thereby effectively disconnect the trigger valve means from the sensing line and operate said trigger valve means in accordance with the pressure level of said capacitor.

7. The system of claim 6 wherein said sensing valve means is a diaphragm valve unit having a diaphragm overlying an orifice and defining an output chamber and an input chamber connected to said sensing line, a coil spring in said input chamber operable to bias said diaphragm into closing and sealing engagement with said orifice, means for adjusting the strength of said coil spring, said output chamber having said orifice aligned with the diaphragm and selectively opened and closed by the movement of the diaphragm and having an output port connected to reference pressure, a diaphragm fluid relay having an input chamber connected to said output port and having an output chamber including a port connected to reference pressure and an orifice selectively opened and closed by a diaphragm, said relay orifice being connected to said capacitor to provide a direct connection of the sensing line connection to reference.

8. The sewage flow system of claim 4 having a reference pressure source and wherein said admission control valve means includes a trigger valve means connecting said source to said controller means and having an input signal chamber and operable to supply a trigger signal pressure to the controller in response to closing, said time delay means including a capacitor connected in series with a restrictor between the input signal chamber of the trigger valve means and said flow line, a vacuum pressure level sensing valve means having an input signal chamber connected to the sewer line and having a valved passageway connected to said source and to the capacitor and restrictor connection, said valve passageway by-passing the capacitor to said source and operative to remove said line pressure from said capacitor in response to the selected decrease in line vacuum pressure, said capacitor connected to the input chamber of the trigger valve means to maintain the valve means actuated for the selected period after the drop in pressure of the line.

9. A sewage flow system employing a vacuum source means connected to the downstream end of at least one sewer line buried in the ground for conducting sewage through the line as a result of pressure and which line may include low accumulating portions, a fluid activated sewer line valve having a pressure responsive pneumatic operator means for opening and closing said sewer line valve, a controller having a pressure responsive input means and a timing means for timed actuation of said operator means in response to a trigger signal of a given minimum time, pneumatic supply means for supplying air to said controller and said operator means, an air admission control means connecting said supply means to said controller and including a pressure responsive trigger valve means coupled to said pressure responsive input means to supply a trigger signal to the controller, said trigger valve means having an input means coupled to said sewer line downstream of said sewer line valve means in series with a time delay means to limit valve operation to an input signal of a minimum duration, vacuum sensing valve means responsive to the line pressure downstream of the line valve means to actuate the time delay means to start the timing cycle, said trigger valve input means transmitting said line pressure to actuate the trigger valve means in response to a selected change in line pressure of said minimum duration, said control means including reset means for resetting the admission control means in response to the opening of the line valve.

10. The system of claim 9 wherein said time delay means is a rechargeable fluid storage means having a restricted discharge passageway to atmosphere to establish a selected discharge rate and operable to hold the trigger valve means in a standby position for a predetermined period after said selected change in line pressure, and said vacuum level sensing valve having an input connected to said sewer line adjacent the line valve and connected to selectively connect said time delay means to said sewer line downstream of the sewer line valve means.

11. The system of claim 9 wherein said time delay means include a rechargeable timing capacitor connected to the input chamber of the trigger valve means, said capacitor having a controlled continuous discharge to atmosphere, a system pressure sensing line, a diode means connecting the capacitor to said sensing line, said sensing valve means being connected to the upstream side of the diode means to by-pass said signal line to atmosphere in response to said abnormal pressure condition and thereby effectively disconnect the trigger valve means from the sensing line and operate said trigger valve means in accordance with the pressure level of said capacitor.

12. The system of claim 9 wherein said sensing valve means is a diaphragm valve unit having a diaphragm defining an output chamber and an input chamber connected to system pressure by a sensing line, said output chamber having an orifice aligned with the diaphragm and selectively opened and closed by the movement of the diaphragm and having an output port connected to atmosphere, level adjustment means in said input chamber operable to bias said diaphragm into closing and sealing engagement with said orifice, a fluid relay having an input chamber connected to said output port and having an output chamber including a port connected to atmosphere and an orifice selectively opened and closed by a diaphragm, said relay orifice being connected to the sensing line to the input side of said capacitor to provide a direct connection of the sensing line connection to atmosphere, and diode means between the capacitor and relay to prevent discharge of the capacitor to said relay.

* * * * *

UNITED STATES PATENT AND TRADEMARK OFFICE

CERTIFICATE OF CORRECTION

PATENT NO. : 4,268,383

DATED : May 19, 1981

INVENTOR(S) : ARNOLD G. TROBAUGH

It is certified that error appears in the above-identified patent and that said Letters Patent are hereby corrected as shown below:

| | |
|---|---|
| Column 7, Line 68<br>~~XXXM~~ CLAIM 1 | After "for" cancel "deliverying" and substitute therefore --- delivering ---. |

Signed and Sealed this

*Twenty-ninth* Day of *September 1981*

[SEAL]

*Attest:*

GERALD J. MOSSINGHOFF

*Attesting Officer*

*Commissioner of Patents and Trademarks*